US008091169B2

(12) United States Patent
Jeutter et al.

(10) Patent No.: US 8,091,169 B2
(45) Date of Patent: Jan. 10, 2012

(54) MOBILE FLOOR-CLEANING APPLIANCE

(75) Inventors: Roland Jeutter, Berglen (DE); Rainer Engelhardt, Leutenbach (DE)

(73) Assignee: Alfred Kaercher GmbH & Co. KG, Winnenden (DE)

( * ) Notice: Subject to any disclaimer, the term of this patent is extended or adjusted under 35 U.S.C. 154(b) by 434 days.

(21) Appl. No.: 12/005,642

(22) Filed: Dec. 27, 2007

(65) Prior Publication Data

US 2008/0141472 A1 Jun. 19, 2008

Related U.S. Application Data

(63) Continuation of application No. PCT/EP2006/006118, filed on Jun. 24, 2006.

(30) Foreign Application Priority Data

Jul. 4, 2005 (DE) ..... 10 2005 032 488

(51) Int. Cl.
*A47L 11/24* (2006.01)

(52) U.S. Cl. ..... 15/41.1; 15/147.1; 15/22.1; 15/22.2; 15/23; 15/54; 15/146.1; 15/144.1; 15/144.2; 15/145

(58) Field of Classification Search ..... 15/44.1, 15/147.1, 22.1, 22.2, 23, 54, 146.1, 144.1, 15/144.2, 145, 257.7
See application file for complete search history.

(56) References Cited

U.S. PATENT DOCUMENTS

| | | | | |
|---|---|---|---|---|
| 2,038,697 | A | 4/1936 | Winslow | |
| 2,432,098 | A * | 12/1947 | Horn | 15/144.1 |
| 2,796,619 | A * | 6/1957 | Hammer | 15/172 |
| 2,887,710 | A * | 5/1959 | Mahoney | 15/172 |
| 3,034,163 | A | 5/1962 | Stevens et al. | |
| 3,360,286 | A * | 12/1967 | Smyth | 403/148 |
| 4,028,765 | A * | 6/1977 | Liebscher | 15/42 |
| 4,095,304 | A | 6/1978 | Shinozaki et al. | |
| 4,182,577 | A * | 1/1980 | O'Dwyer et al. | 403/74 |
| 2002/0100130 | A1 | 8/2002 | Fischer | |
| 2002/0120994 | A1 * | 9/2002 | Hirse | 15/119.2 |
| 2003/0028988 | A1 * | 2/2003 | Streutker et al. | 15/228 |
| 2005/0011028 | A1 * | 1/2005 | Chow | 15/41.1 |

FOREIGN PATENT DOCUMENTS

| | | |
|---|---|---|
| CN | 2579331 | 10/2003 |
| DE | 621 996 | 11/1935 |
| DE | 27 11 801 | 9/1978 |

(Continued)

*Primary Examiner* — Robert Scruggs

(74) *Attorney, Agent, or Firm* — Lipsitz & McAllister, LLC

(57) ABSTRACT

The invention relates to a mobile floor-cleaning appliance having a housing in which a cleaning tool is mounted, and having a handle holder which is mounted on the housing and is adapted to be connected to a handle in order to guide the appliance along a floor surface which is to be cleaned. In order to develop the mobile floor-cleaning appliance such that the handle holder can be reliably arrested in a rest position and can easily be transferred from the rest position into an operating position, it is proposed according to the invention that the handle holder is adapted to be pivoted about two pivot axes oriented obliquely or perpendicularly in relation to one another and is adapted to be arrested in a rest position, at least one arresting element being associated with each of the two pivot axes, for arresting the handle holder, wherein it is possible to eliminate the arresting action on the handle holder in relation to the two pivot axes by virtue of the handle holder being pivoted as desired out of the rest position about one of the two pivot axes.

18 Claims, 3 Drawing Sheets

FOREIGN PATENT DOCUMENTS

| | | |
|---|---|---|
| DE | 299 03 196 | 6/1999 |
| DE | 299 13 845 | 12/1999 |
| DE | 200 21 446 | 4/2001 |
| DE | 203 11 252 | 10/2003 |
| GB | 2 088 202 | 6/1982 |
| WO | 2004/080265 | 9/2004 |

* cited by examiner

MOBILE FLOOR-CLEANING APPLIANCE

This application is a continuation of international application number PCT/EP2006/006118 filed on Jun. 24, 2006.

The present disclosure relates to the subject matter disclosed in international application number PCT/EP2006/006118 of Jun. 24, 2006 and German application number 10 2005 032 488.6 of Jul. 4, 2005, which are incorporated herein by reference in their entirety and for all purposes.

BACKGROUND OF THE INVENTION

The invention relates to a mobile floor-cleaning appliance having a housing in which a cleaning tool is mounted, and having a handle holder which is mounted on the housing and is adapted to be connected to a handle in order to guide the floor-cleaning appliance along a floor surface which is to be cleaned.

By means of floor-cleaning appliances of this kind, a floor surface can easily be cleaned by virtue of the appliance being guided along the floor surface. In order to guide the appliance along the floor surface, the appliance has a handle which is mounted, via a handle holder, on the housing of the floor-cleaning appliance. The floor-cleaning appliance may be configured, for example, as a mobile sweeping appliance, the housing containing a rotationally driven brush roller, and a dirt-collecting container being disposed adjacent to the brush roller, so that the brush roller, which is preferably driven by means of an electric motor, can pick up dirt from the floor surface, the dirt then being transferred into the dirt-collecting container. Such sweeping appliances are known, for example, from DE 299 13 845 U1.

In particular for the purpose of storing the floor-cleaning appliance, it is advantageous if the handle holder and the handle connected thereto can be arrested in a rest position with predetermined orientation, in particular with vertical orientation.

For the purpose of mounting a handle holder on the housing of a cleaning appliance, DE 299 03 196 U1 proposes a cardan joint, with the aid of which the handle holder can be pivoted about two pivot axes oriented perpendicularly to one another. Moreover, the handle holder can be arrested in a rest position with vertical orientation. For this purpose, it has, at its end which is directed toward the housing, a latching protrusion which can be introduced into a corresponding latching mount of the housing. A not inconsiderable amount of force is necessary both in order to release and in order to produce the arresting action.

It is an object of the present invention to develop a mobile floor-cleaning appliance of the type mentioned in the introduction such that the handle holder can be reliably arrested in a rest position and can easily be transferred from the rest position into an operating position.

SUMMARY OF THE INVENTION

This object is achieved according to the invention, in the case of a mobile floor-cleaning appliance of the generic type, in that the handle holder is mounted on the housing such that it can be pivoted about two pivot axes oriented obliquely or perpendicularly in relation to one another and can be arrested in a rest position, at least one arresting element being associated with each of the two pivot axes, for arresting the handle holder, and, by virtue of the handle holder being pivoted as desired out of the rest position about one of the two pivot axes, it is possible to eliminate the arresting action on the handle holder in relation to the two pivot axes.

Arrest of the handle holder in its rest position is effected, in the case of the floor-cleaning appliance according to the invention, with the aid of at least two arresting elements, which are each associated with a pivot axis. The arresting elements arrest the handle holder in its rest position in each case in relation to the associated pivot axis, that is to say at least a first arresting element, in the rest position of the handle holder, prevents the latter from pivoting about a first pivot axis, and at least a second arresting element, in the rest position of the handle holder, prevents the latter from pivoting about a second pivot axis. Overall, this allows the handle holder to be reliably arrested in its rest position in a manner which allows it to be subjected to mechanical loading. If the handle holder is to be transferred into an operating position, then all that is required for this purpose is for the handle holder to be pivoted out of the rest position about one of the two pivot axes. This pivoting-out movement, then, results in a release of the arresting action in relation to the two pivot axes. The sweeping appliance according to the invention is thus also distinguished by very straightforward handling.

It is advantageous if the arresting elements, in the rest position of the handle holder, engage with a retaining part disposed between the arresting elements, the arresting elements releasing the retaining part by virtue of the handle holder being pivoted out of the rest position. By virtue of the arresting elements interacting with the retaining part, it is possible for the handle holder, in its rest position, to be oriented at a fixed, predetermined angle in relation to the housing. The arresting elements here engage with the retaining part. If the handle holder is pivoted out of the rest position, then the arresting elements release the retaining part, so that the arresting action on the handle holder is eliminated.

It is advantageous if at least one arresting element, in the rest position of the handle holder, is biased in a resiliently elastic manner in the direction of the retaining part. For biasing purposes, at least one arresting element can be acted on by a force in the direction of the retaining part by means of a compression spring. By selecting the strength of the compression spring, the amount of force which is necessary for arresting purposes can thus be predetermined in a constructionally simple manner.

As an alternative, or in addition, it may be provided that the retaining part, in the rest position of the handle holder, is biased in a resiliently elastic manner in the direction of at least one arresting element.

In the case of a constructionally simple embodiment which is cost-effective to produce, the retaining part, in the rest position of the handle holder, is disposed between the arresting elements. The retaining element may be, for example, in pin form, in each case at least one arresting element butting, in the rest position of the handle holder, against the ends of the retaining part which face away from one another. In particular, it may be provided that in each case one arresting element butts against the ends of the retaining part, so that the two arresting elements, in the rest position of the handle holder, are aligned with one another. By virtue of the handle holder being pivoted out of its rest position, it is possible to eliminate the aligned arrangement of the two arresting elements, the two arresting elements disengaging from the retaining part disposed between them, so that the arresting action on the handle holder is eliminated.

The retaining part, together with the handle holder, can preferably be pivoted about one of the two pivot axes, and at least one arresting element is held such that it cannot be pivoted in relation to this pivot axis. The retaining part can thus easily be moved relative to at least one arresting element by virtue of the handle holder being pivoted. In order to produce the arresting action, the retaining part, together with the handle holder, can be moved into a position in which the at least one arresting element engages with the retaining part and thus blocks the movement about the pivot axis associated with the arresting element.

It is advantageous if at least one arresting element, together with the handle holder, can be pivoted about one of the pivot axes, and the retaining element is held such that it cannot be pivoted in relation to this pivot axis. The at least one arresting element can thus be transferred, together with the handle holder, into a position in which it engages with the retaining part, so that movement of the handle holder about the pivot axis associated with the arresting element is blocked.

In the case of a particularly advantageous embodiment, the retaining part is held in an articulation component, the articulation component being mounted such that it can be pivoted about one of the two pivot axes and the retaining part being held in the articulation component such that it can be displaced in a direction transverse to this pivot axis. The articulation component may be mounted, for example on the upper side of the housing of the sweeping appliance, such that it can be pivoted about a first pivot axis. The first pivot axis is preferably oriented perpendicularly to the main movement direction of the floor-cleaning appliance. The retaining part is held on the articulation component such that it can be displaced transversely to the first pivot axis. It can thus be pivoted, together with the articulation component, about the pivot axis and, in addition, it can be displaced perpendicularly to the pivot axis.

In the case of a constructionally simple configuration, the retaining part is configured as a sleeve.

It is advantageous if the arresting elements each have a ball portion which, in the rest position of the handle holder, penetrates into a receiving portion of the retaining part. In particular, the arresting elements may be in the form of balls, for example steel balls.

Preferably at least one arresting element is secured on the handle holder. It may be held, for example, in a recess of the handle holder, in particular it can be pressed into the recess. The recess can be formed in the handle holder.

It is advantageous if the recess is formed in an arcuate end surface of the handle holder.

It is advantageous if the arcuate end surface is configured concentrically in relation to a pivot axis of the handle holder. It is thus possible to ensure, when the handle holder is pivoted about this pivot axis, a constant spacing between the end surface of the handle holder and the other pivot axis.

In the case of a preferred embodiment, at least one arresting element is held on the housing of the sweeping appliance such that it cannot be pivoted. By virtue of the handle holder being pivoted into its rest position, this arresting element can then block any further movement of the handle holder about the pivot axis associated with the arresting element.

The at least one arresting element held on the housing of the sweeping appliance, together with a spring, is advantageously disposed in an accommodating part, the spring applying force to the arresting element in the direction of the retaining part. It is possible for the spring to be supported on a supporting surface of the accommodating part and to subject the arresting element to a spring force in order to secure the retaining part and thus to arrest the handle holder in its rest position.

The accommodating part preferably has a stop which limits the movement of the arresting element in the direction of the retaining part. This ensures, in a constructionally simple manner, that the arresting element can indeed be acted on by a spring force in the direction of the retaining part, so that the handle holder is reliably arrested in its rest position, but, if the handle holder is pivoted into an operating position, then the arresting element releases the retaining part, in which case it can then come into abutment against the stop. The arresting element is thus retained in captive fashion in the accommodating part.

The accommodating part may be configured, for example, as a bushing which is positioned in a recess of the housing. It has proven to be advantageous to produce the bushing from metal, preferably from brass.

In the case of a particularly preferred embodiment of the invention, the mobile floor-cleaning appliance is configured as a sweeping appliance, the cleaning tool being in the form of a brush roller mounted in a rotatable manner in the housing, and a dirt-collecting container being disposed adjacent to the brush roller. It is advantageous here if the brush roller can be made to rotate by an electric motor. It is particularly advantageous here if the sweeping appliance comprises a rechargeable battery for supply of power to the electric motor. The handle holder is then preferably articulated on the housing in a region between the battery and the brush roller. It has been found that this can simplify the guidance of the sweeping appliance along the floor surface which is to be swept.

A more detailed explanation will be given by way of the following description of a preferred embodiment of the invention in conjunction with the drawings.

DETAILED DESCRIPTION OF THE INVENTION

Figure 1:
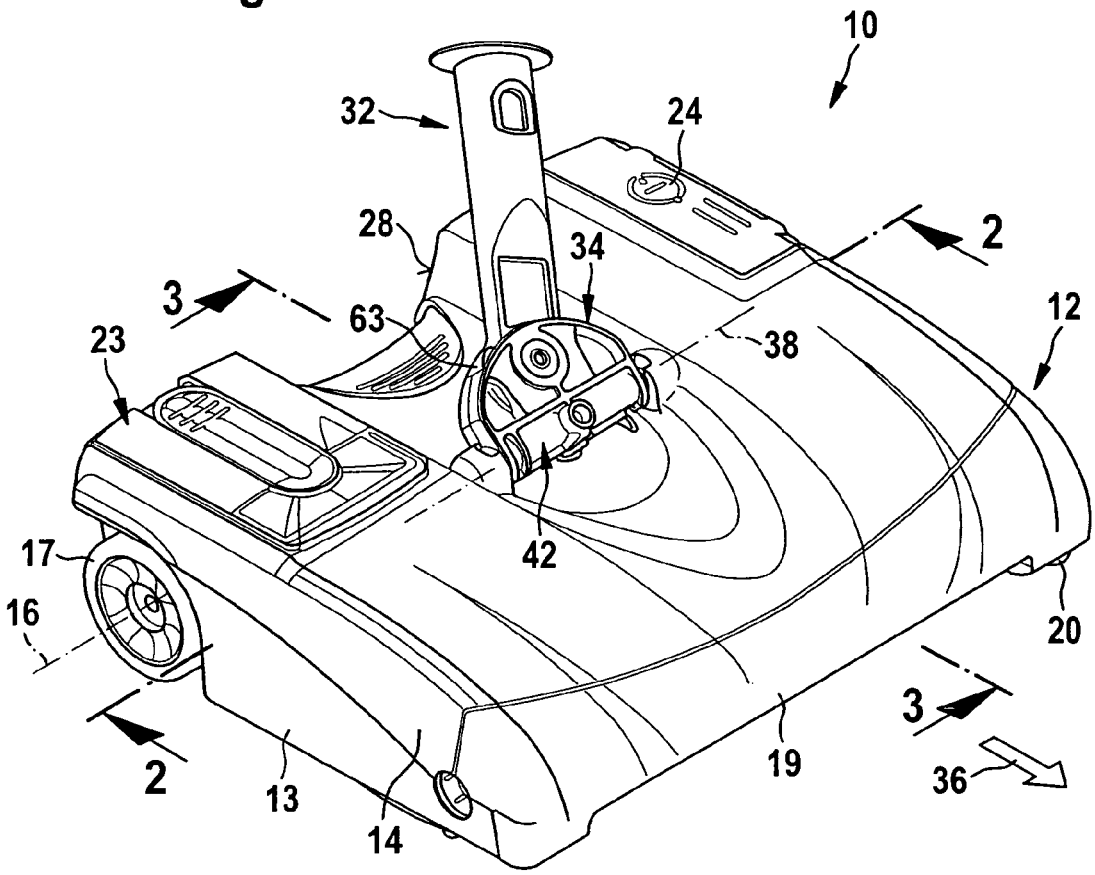
FIG. 1 shows a perspective illustration of a floor-cleaning appliance according to the invention.

The drawing illustrates, schematically, a floor-cleaning appliance, designated overall by reference numeral 10, which is in the form of a mobile sweeping appliance and has a housing 12 comprising a lower housing part 13 and an upper housing part 14. Two running wheels 17, 18 are mounted on the lower housing part 13 such that they are freely rotatable about a common axis of rotation 16. At a distance from the running wheels 17, 18, and adjacent to a front side 19 of the housing 12, two supporting rollers are mounted such that they can be freely rotated about an axis of rotation which is rotatable parallel to the axis of rotation 16, only one supporting roller 20 being visible in the drawing.

Figure 3:
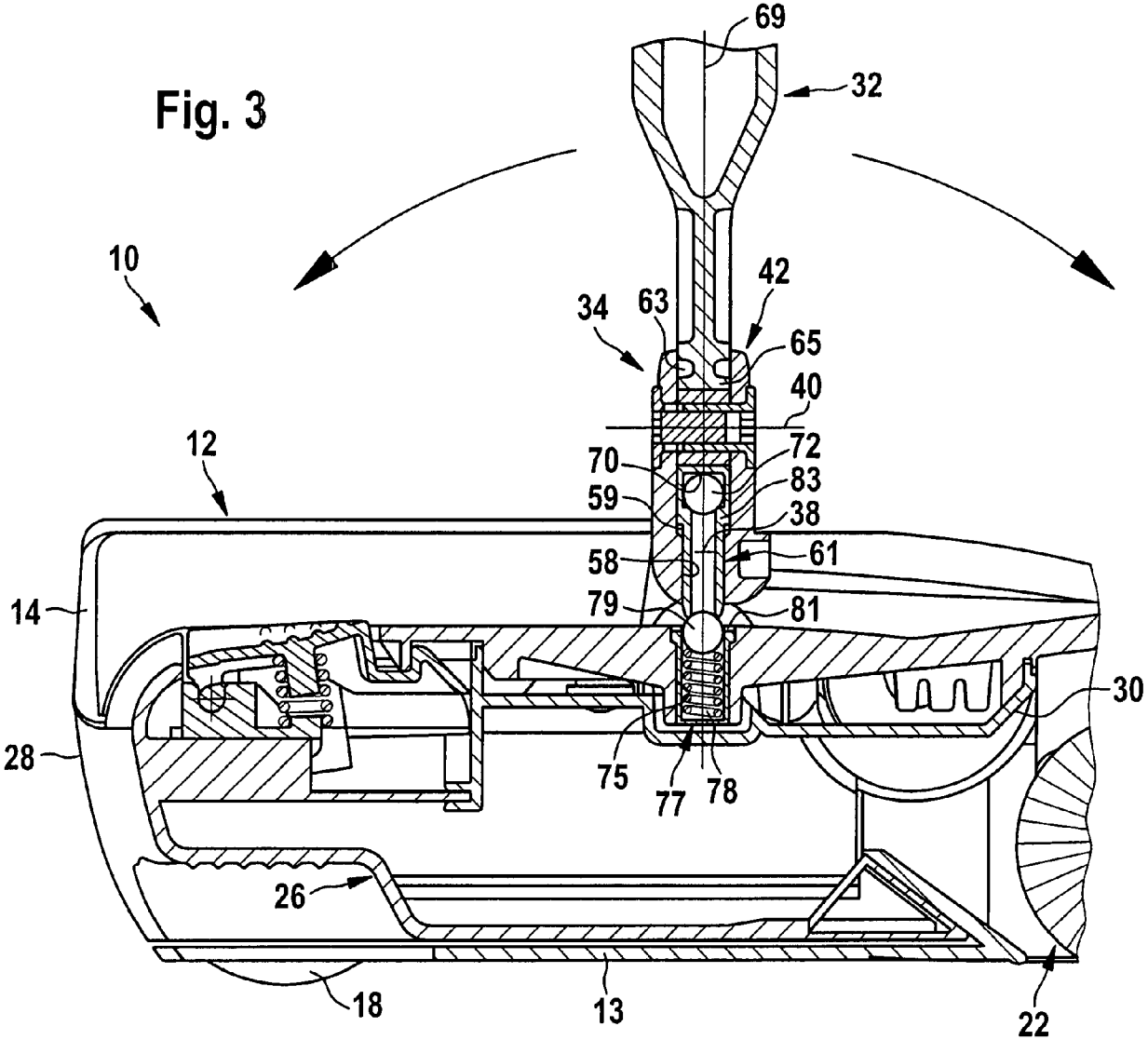
FIG. 3 shows a sectional view along line 3-3 in FIG. 1.

Within the housing 12, a brush roller 22, which can be seen in FIG. 3, is mounted such that it can be rotated about an axis of rotation oriented parallel to the axis of rotation 16, this brush roller interacting, via a belt drive which is known per se and is therefore not illustrated in the drawing, with an electric motor which is known per se to a person skilled in the art and therefore, in order to provide for better clarity, has not been illustrated either. Power supply to the electric motor is effected by means of a rechargeable battery 23, and the electric motor can be switched on and off with the aid of a switch 24 disposed on the upper side of the upper housing part 14. The housing 12 also accommodates a dirt-collecting container 26 which can be pushed into the housing 12, in the manner of a drawer, on the rear side 28 of the housing 12, the rear side being directed away from the front side 19, and can be latched in a releasable manner to this housing. The dirt-collecting container 26 has a dirt-inlet opening 30 disposed directly adjacent to the brush roller 22. Dirt which has been swept by the brush roller 22 from the floor surface which is to be cleaned can thus be transferred into the dirt-collecting container 26 via the dirt-inlet opening 30.

In order to guide the sweeping appliance 10 along the floor surface which is to be cleaned, the sweeping appliance 10 has a handle holder 32 into which a handle, which is known per se and is therefore not illustrated in the drawing, can be inserted and which is mounted on the upper side of the upper housing part 14 by means of a cardan joint 34. The cardan joint 34 allows a pivoting movement of the handle holder about a first pivot axis 38, which is oriented perpendicularly to the main movement direction 36 and thus parallel to the axis of rotation 16 of the running wheels 17, 18, and a pivoting movement about a second pivot axis 40, which in the embodiment illustrated runs perpendicularly to the first pivot axis 38 and is spaced apart therefrom.

Figure 2:
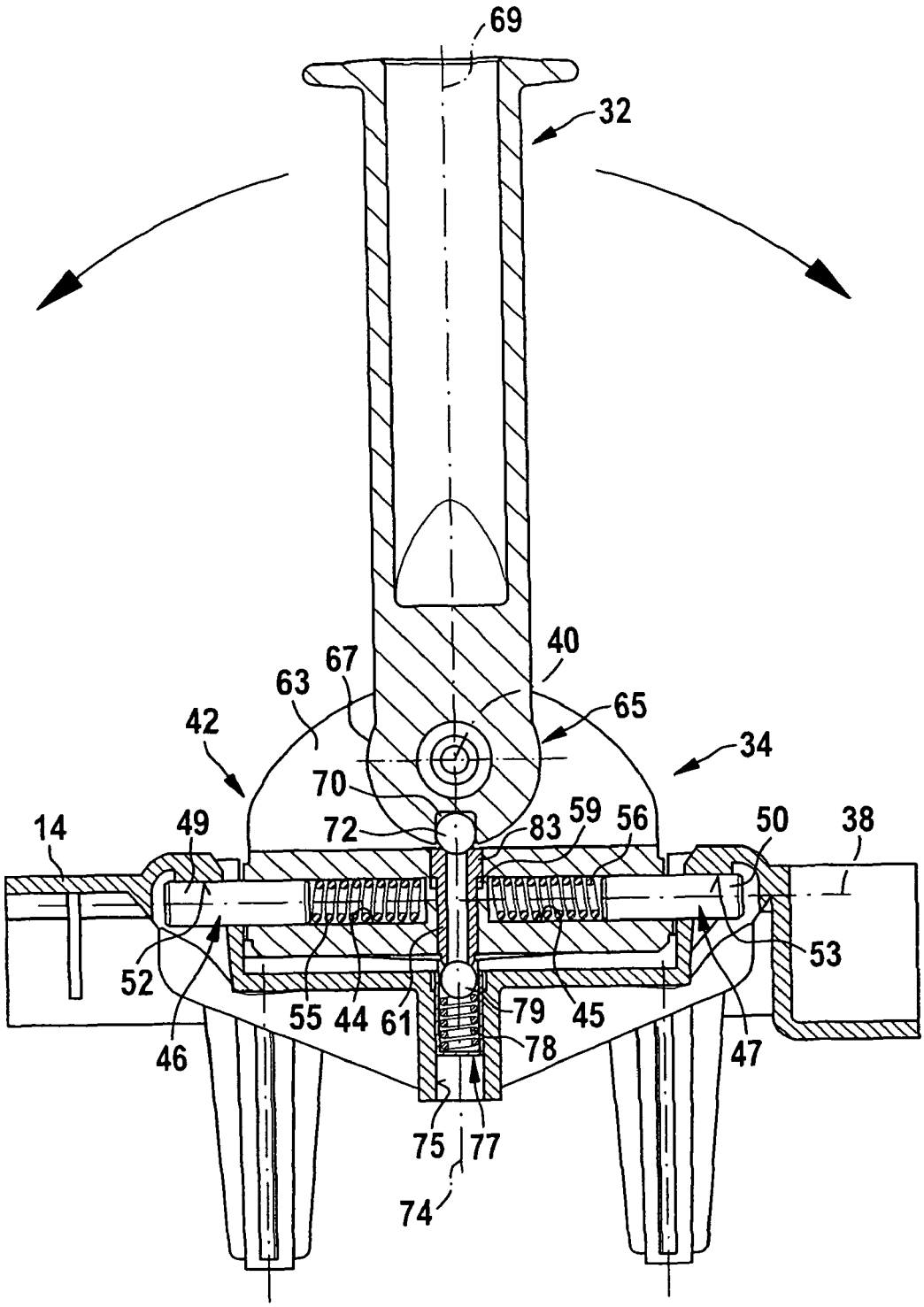
FIG. 2 shows a sectional view along line 2-2 in FIG. 1.

As is clear, in particular, from FIG. 2, the cardan joint 34 has an articulation component 42 with two blind bores 44, 45 which face away from one another and are aligned with the first pivot axis 38, in each of which a respective articulation pin 46, 47 is located, which, by way of its respective end region 49, 50 projecting outward beyond the articulation component 42, penetrates into an associated bearing recess 52, 53, respectively, of the upper housing part 14. By means of a respective compression spring 55, 56, which is disposed in the respective blind bore 44, 45, the articulation pins 46 and 47 are forced into the associated bearing recesses 52 and 53.

The articulation component 42 is mounted on the upper housing part 14, with the aid of the articulation pins 46, 47, such that it can be pivoted about the first pivot axis 38.

Between the two blind bores 44 and 45, the articulation component 42 has a through-bore 58 which is oriented perpendicularly to the first pivot axis 38 and widens, via a step 59, in the direction away from the upper housing part 14. The through-bore 58 accommodates a retaining part in the form of a sleeve 61 which is retained in a displaceable manner in the through-bore 58 and is produced from a metal or a high-grade plastics material.

The through-bore 58 opens out, at its end which is directed away from the upper housing part 14, into an accommodating chamber 63 of the articulation component 42, this chamber accommodating an end piece 65 of the handle holder 32. In the region of the accommodating chamber 63, the handle holder 32 is articulated on the articulation component 42 such that it can be pivoted about the second pivot axis 40. The end surface 67 of the handle holder 32, this end surface being directed toward the sleeve 61, is in the form of an arc of a circle and is configured concentrically in relation to the second pivot axis 40. In alignment with a longitudinal axis 69 of the handle holder 32, a recess 70 is formed in the end surface 67, and a first arresting element in the form of a first arresting ball 72 is pressed into this recess. The arresting ball has a ball portion projecting beyond the recess 70 in the direction of the sleeve 61.

The handle holder 32 is illustrated in FIG. 1 in an operating position in which it can be freely pivoted about the two pivot axes 38, 40. FIGS. 2 and 3 show the handle holder 32 in a rest position, in which it has been arrested with predetermined orientation, in the embodiment illustrated with vertical orientation. In the rest position, the longitudinal axis 69 of the handle holder 32 is aligned with the axis 74 of a cylindrical housing recess 75 of the upper housing part 14, a cylindrical accommodating part 77 being pressed into this housing recess. The accommodating part 77 accommodates a compression spring 78 and a second arresting element in the form of a second arresting ball 79. The second arresting ball 79 here is forced in the direction of the sleeve 61 by the compression spring 78. A radially inwardly directed periphery 81 at that end of the accommodating part 77 which is directed toward the sleeve 61 forms a stop against which the second arresting ball 79 butts when the handle holder 32 assumes an operating position.

In the rest position of the handle holder 32, the two arresting balls 72 and 79 are aligned with one another and engage with the sleeve 61. The second arresting ball 79 here is biased by the compression spring 78 in the direction of the sleeve 61, which transmits the spring force to the first arresting ball 72, this resulting in a stable position of the handle holder 32 overall, as is illustrated in FIGS. 2 and 3.

If the handle holder 32, starting from its rest position, is pivoted about the first pivot axis 38, then the second arresting ball 79 disengages from the sleeve 61 and, on account of the spring force acting on it, positions itself on the periphery 81. On account of its weight, the sleeve 61 is then displaced downward within the through-bore 58 until it butts, by way of a collar 83 directed away from the second arresting ball 79, against the step 59 of the through-bore 58. In order to compensate for production tolerances, a spring, which is compressed by the weight of the sleeve 61, may be disposed between the collar 83 and the step 59. The movement of the sleeve 61 has the result that the sleeve 61 also disengages from the first arresting ball 72 and the arresting action on the handle holder 32, both in relation to its first pivot axis 38 and in relation to its second pivot axis 40, is thus eliminated. The handle holder 32 can then assume any desired operating position and can be freely pivoted about the pivot axes 38, 40.

If the handle holder 32, starting from its rest position, is pivoted about the second pivot axis 40, then the first arresting ball 72, which has been pressed into the recess 70, releases the sleeve 61, which then, on account of the spring force to which it is subjected by the compression spring 78 via the second arresting ball 79, is displaced upward within the through-bore 58 until it butts against the arcuate end surface 67 of the handle holder 32. The second arresting ball 79 here moves up to the periphery 81. The latter prevents the sleeve 61 from being subjected any further to the force of the compression spring 78. Pivoting the handle holder 32, starting from its rest position, about the second pivot axis 40 thus also eliminates the arresting action on the handle holder about the first pivot axis 38. The handle holder 32 can then assume any desired operating position.

It is clear from the above that the handle holder 32 can be reliably arrested in its rest position by means of the arresting balls 72 and 79, which each ensure the arresting action on the handle holder 32 in relation to one of the two pivot axes 38 and 40. A straightforward pivoting movement out of the rest position about the first or the second pivot axis 38 or 40, respectively, allows the arresting action in relation to the two pivot axes 38 and 40 to be easily released again.

The invention claimed is:

1. Mobile floor-cleaning appliance, comprising:

a cleaning tool, a housing in which the cleaning tool is mounted, a handle holder which is mounted on the housing and is adapted to be connected to a handle in order to guide the floor-cleaning appliance along a floor surface which is to be cleaned, the handle holder being adapted to be pivoted about two pivot axes oriented obliquely or perpendicularly in relation to one another and adapted to be arrested in a rest position, and at least one arresting element associated with each of the two pivot axes, for arresting the handle holder in the rest position, a retaining part disposed between the arresting elements, each of the at least one arresting elements, in the rest position of the handle holder, engaging with the retaining part to arrest the handle holder, and each of the at least one arresting elements releasing the retaining part, and thereby eliminating the arresting action on the handle holder in relation to the two pivot axes, by virtue of the handle holder being pivoted as desired out of the rest position about only one of the two pivot axes.

2. Floor-cleaning appliance according to claim 1, wherein at least one of the arresting elements, in the rest position of the handle holder, is biased in a resiliently elastic manner in a direction of the retaining part.

3. Floor-cleaning appliance according to claim 1, wherein the retaining part, in the rest position of the handle holder, is biased in a resiliently elastic manner in a direction of at least one arresting element.

4. Floor-cleaning appliance according to claim 1, wherein:

the retaining part, together with the handle holder, can be pivoted about one of the two pivot axes, and at least one of the arresting elements is held such that it cannot be pivoted in relation to the one pivot axis.

5. Floor-cleaning appliance according to claim 1, wherein:

at least one of the arresting elements, together with the handle holder, can be pivoted about one of the two pivot axes, and the retaining part is held such that it cannot be pivoted in relation to this the one pivot axis.

6. Floor-cleaning appliance according to claim 1, wherein the retaining part is held in an articulation component, the articulation component being mounted such that it can be pivoted about one of the two pivot axes, and the retaining part being held in the articulation component such that it can be displaced in a direction transverse to the one pivot axis.

7. Floor-cleaning appliance according to claim 1, wherein the retaining part is configured as a sleeve.

8. Floor-cleaning appliance according to claim 1, wherein the arresting elements each have a ball portion which, in the rest position of the handle holder, penetrates into a receiving portion of the retaining part.

9. Floor-cleaning appliance according to claim 1, wherein the arresting elements are in the form of balls.

10. Floor-cleaning appliance according to claim 1, wherein at least one of the arresting elements is secured on the handle holder.

11. Floor-cleaning appliance according to claim 10, wherein the arresting element is held in a recess of the handle holder.

12. Floor-cleaning appliance according to claim 10, wherein the recess is formed in an arcuate end surface of the handle holder.

13. Floor-cleaning appliance according to claim 12, wherein the arcuate end surface is configured concentrically in relation to a pivot axis.

14. Floor-cleaning appliance according claim 1, wherein at least one of the arresting elements is held on the housing such that it cannot be pivoted.

15. Floor-cleaning appliance according to claim 14, wherein the at least one arresting element, together with a spring, is disposed in an accommodating part, the spring applying force to the arresting element in a direction of the retaining part.

16. Floor-cleaning appliance according to claim 15, wherein the accommodating part comprises a stop which limits movement of the arresting element in the direction of the retaining part.

17. Floor-cleaning appliance according to claim 15, wherein the accommodating part is configured as a bushing which is positioned in a recess of the housing.

18. Floor-cleaning appliance according to claim 1, wherein the floor-cleaning appliance is configured as a sweeping appliance, the cleaning tool being in the form of a brush roller mounted in a rotatable manner in the housing, and a dirt-collecting container being disposed adjacent to the brush roller.

* * * * *